US005474255A

United States Patent [19]

Levita

[11] Patent Number: 5,474,255

[45] Date of Patent: Dec. 12, 1995

[54] UPGRADING FIRE CONTROL SYSTEMS

[75] Inventor: Gideon Levita, Haifa, Israel

[73] Assignee: State of Israel-Ministry of Defence, Armament Development Authority-Rafael, Haifa, Israel

[21] Appl. No.: 345,711

[22] Filed: Nov. 22, 1994

[30] Foreign Application Priority Data

Nov. 22, 1993 [IL] Israel ..... 107707

[51] Int. Cl.[6] ..... F41G 7/24; F41G 5/08

[52] U.S. Cl. ..... 244/3.14; 342/67; 89/41.07

[58] Field of Search ..... 244/3.11, 3.14; 342/67; 89/41.07

[56] References Cited

U.S. PATENT DOCUMENTS

| | | | |
|---|---|---|---|
| 2,557,949 | 6/1951 | Deloraine | 244/3.14 |
| 4,004,729 | 1/1977 | Rawicz et al. | 89/41.07 |
| 4,093,153 | 6/1978 | Bardash et al. | 244/3.14 |
| 4,124,849 | 11/1978 | Zahornasky et al. | 342/67 |
| 4,622,554 | 11/1986 | Gellekink et al. | 342/67 |
| 4,975,705 | 12/1990 | Gellekink et al. | 342/67 |

*Primary Examiner*—Charles T. Jordan
*Assistant Examiner*—Theresa M. Wesson
*Attorney, Agent, or Firm*—Mark M. Friedman

[57] ABSTRACT

A conversion kit for upgrading an existing fire control radar system having a target radar antenna for tracking a target to enable the system also to track, with respect to the target, a missile having a beacon transmitter. The conversion kit includes a missile antenna for measuring and commanding the missile, a mechanism for attaching the missile antenna to the target radar antenna of the fire control radar system, a command transmitter for transmitting command signals via the missile antenna to a missile, a beacon receiver for receiving from the missile, via the missile antenna, response signals from the missile beacon transmitter in response to the reception by the missile of the command signals, and a guidance computer for utilizing the command signals transmitted by command transmitter, and the response signals received from the missile beacon transmitter, and target tracking signals received from the fire control radar system, for tracking the missile and for guiding it to the target.

8 Claims, 8 Drawing Sheets

UPGRADING EXISTING RADAR WITH "BARAK" MISSILES

TRANSMITTER BLOCK DIAGRAM

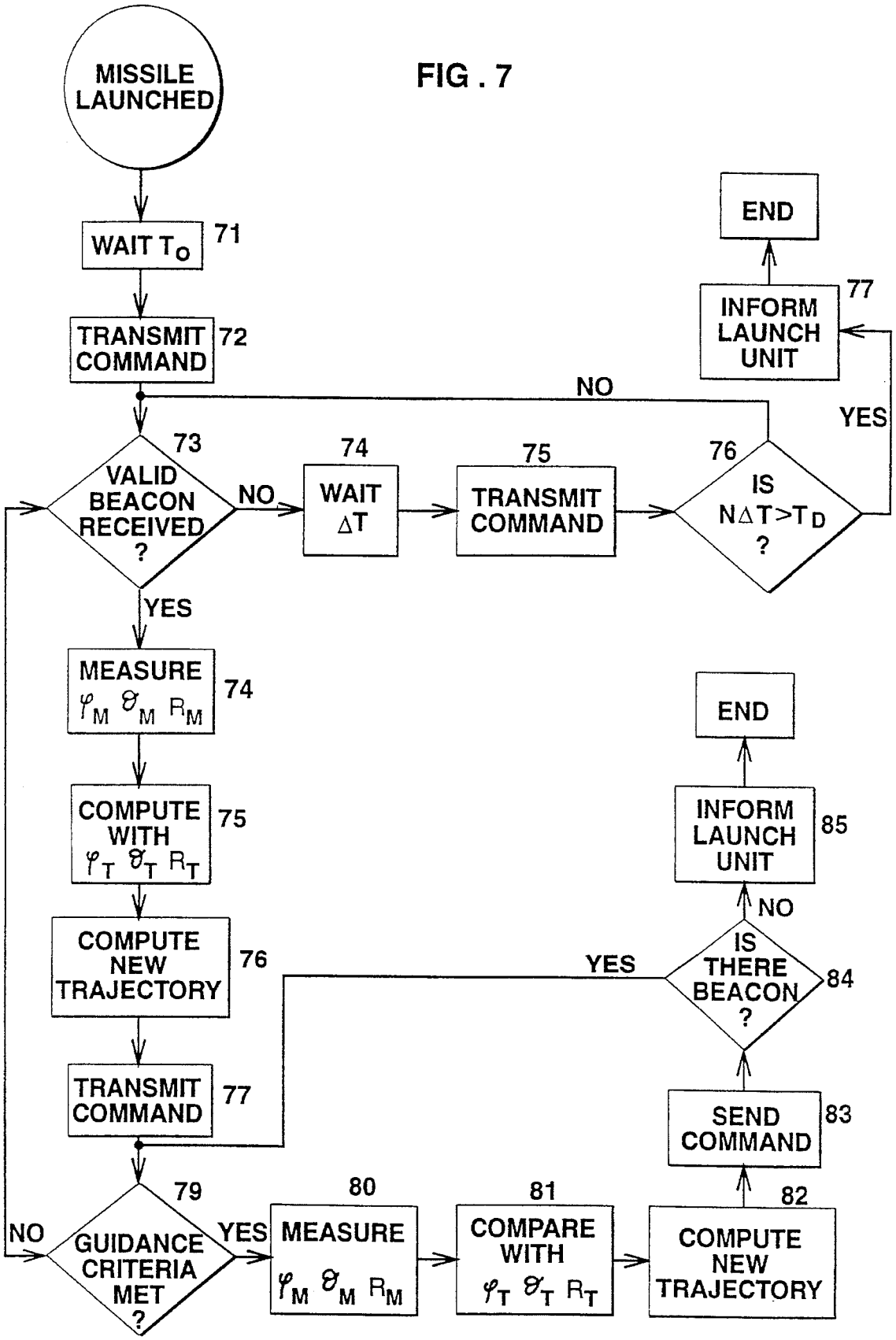
FIG. 7
MISSILE LAUNCHED
WAIT $T_O$
71
TRANSMIT COMMAND
72
NO
YES
73
VALID BEACON RECEIVED ?
NO
74
WAIT $\Delta T$
75
TRANSMIT COMMAND
76
IS $N\Delta T > T_D$ ?
77
INFORM LAUNCH UNIT
END
YES
MEASURE $\varphi_M$ $\theta_M$ $R_M$
74
COMPUTE WITH $\varphi_T$ $\theta_T$ $R_T$
75
COMPUTE NEW TRAJECTORY
76
TRANSMIT COMMAND
77
79
GUIDANCE CRITERIA MET ?
NO
YES
80
MEASURE $\varphi_M$ $\theta_M$ $R_M$
81
COMPARE WITH $\varphi_T$ $\theta_T$ $R_T$
82
COMPUTE NEW TRAJECTORY
83
SEND COMMAND
84
IS THERE BEACON ?
YES
NO
85
INFORM LAUNCH UNIT
END FIG . 8
SYNTHETIC TARGET
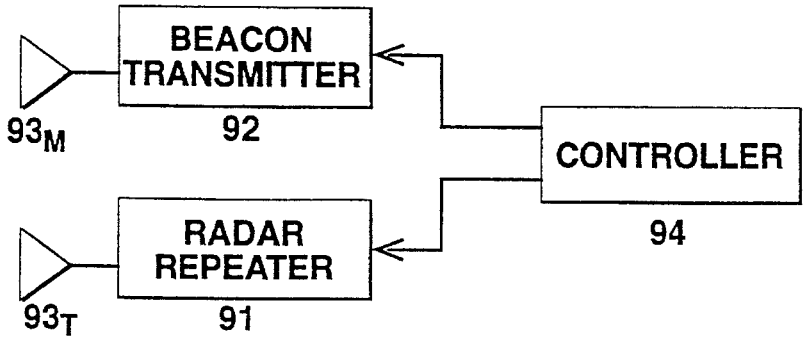
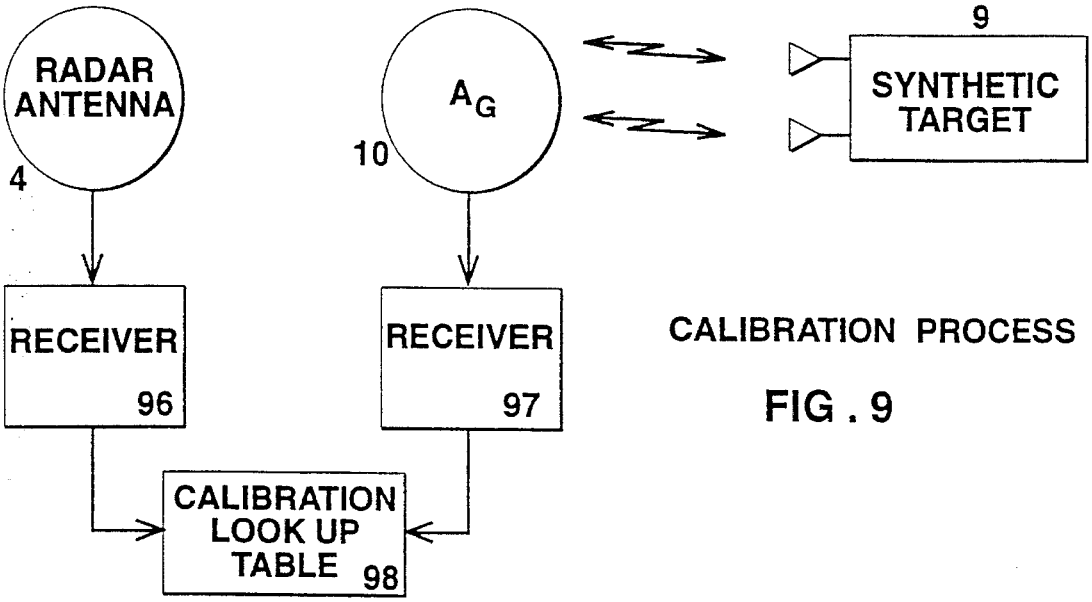
CALIBRATION PROCESS
FIG . 9
BORESIGHT TEMPERATURE COMPENSATION
FIG . 10
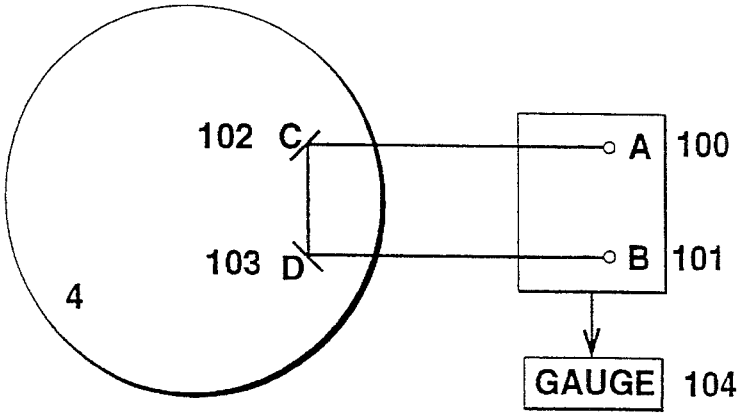

UPGRADING FIRE CONTROL SYSTEMS

The present invention relates to fire control radar systems, and particularly to a conversion kit for upgrading an existing fire control radar system designed to control gun batteries with respect to incoming targets and also to track and guide missiles towards incoming targets.

Fire control radar systems for controlling gun batteries with respect to incoming targets have been in extensive use for a considerable period of time. Also known are fire control radar systems for controlling missiles, in which the missile includes a beacon transmitter transmitting a beacon signal to a receiver in the fire control radar system to aid the system in tracking and guiding the missile to the target. While the first system has low probability of kill with respect to the second, the second one is very expensive due to the cost of the missiles battery and to the additional fire control radar to track the missile in its trajectory towards the target.

An object of the present invention is to provide an arrangement for enhancing an existing fire control radar system designed to control gun batteries also to control missiles, which arrangement involves a small fraction of the cost that normally be required in providing a separate fire control radar system for missiles.

According to the present invention, there is provided a conversion kit for upgrading an existing fire control radar system having a target radar antenna for tracking a target to enable the system also to track, with respect to the target, a missile having a beacon transmitter, the conversion kit comprising: missile antenna means for measuring and commanding the missile; means for attaching the missile antenna means to the target radar antenna of the fire control radar system; a command transmitter for transmitting command signals via the missile antenna means to a missile; a beacon receiver for receiving from the missile, via the missile antenna means, response signals from the missile beacon transmitter in response to the reception by the missile of the command signals; and a guidance computer for utilizing the command signals transmitted by the command transmitter, and the response signals received from the missile beacon transmitter, and tracking signals received from the fire control radar system, for measuring the missile's trajectory and for guiding the same to the target.

According to further features in the preferred embodiment of the invention described below, the kit further includes means for generating a synthetic target at a predetermined known location with respect to the missile antenna means to enable self-calibration of the conversion kit with respect to the target radar antenna for different locations of the target and for different working frequencies.

According to still further features in the described preferred embodiment, the kit further includes means for measuring the physical distortion of the target radar antenna because of variations in temperature, the guidance computer including means for correcting the tracking of the missile and the guidance thereof to the target to compensate for the physical distortion.

As will be described more particularly below, the invention thus utilizes the beacon signal transmitted by the missile for tracking the missile and guiding it to the target, thereby obviating the need for a separate fire control radar system for this purpose. The invention thus enables existing fire control radar systems to be upgraded to add this additional capability at a small fraction of the cost that otherwise would be required in providing a separate fire control radar system for this purpose.

Further features and advantages of the invention will be apparent from the description below.

The invention is herein described, by way of example only, with reference to the accompanying drawings, wherein:

FIG. 1 pictorially illustrates a fire control radar system designed for controlling gun batteries upgraded by a conversion kit in accordance with the present invention to enable it also to control missiles;

FIG. 1*a* illustrates additional applications of the conversion kit of FIG. 1;

Figure 4:
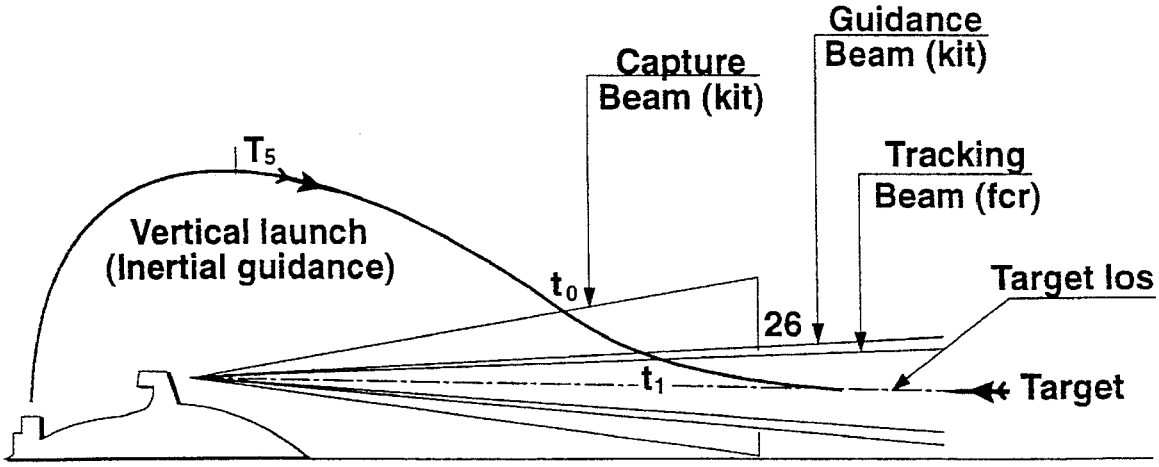
Figure 3:
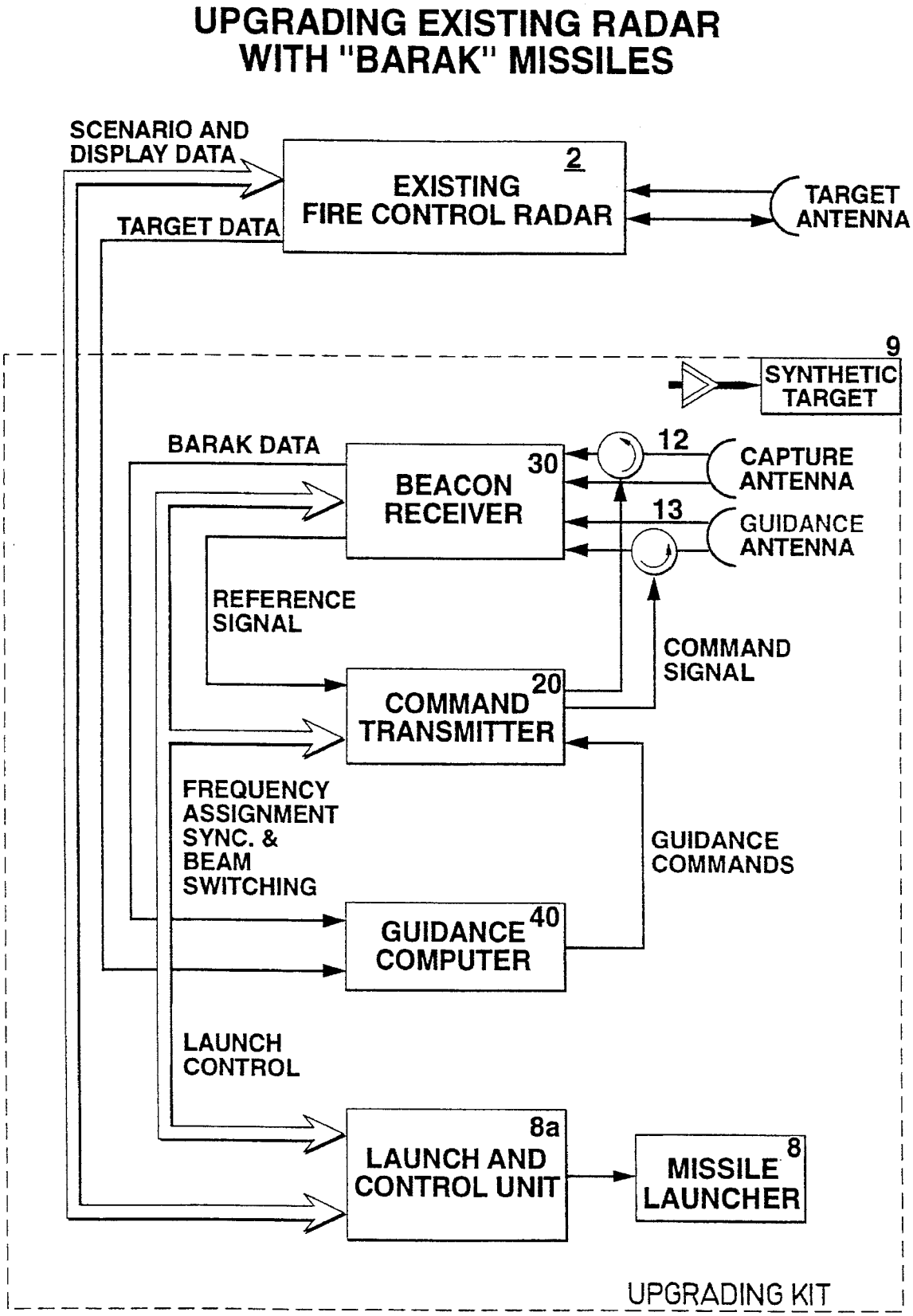
FIG. 3 is a block diagram illustrating the main components of the conversion kit.
Figure 5:
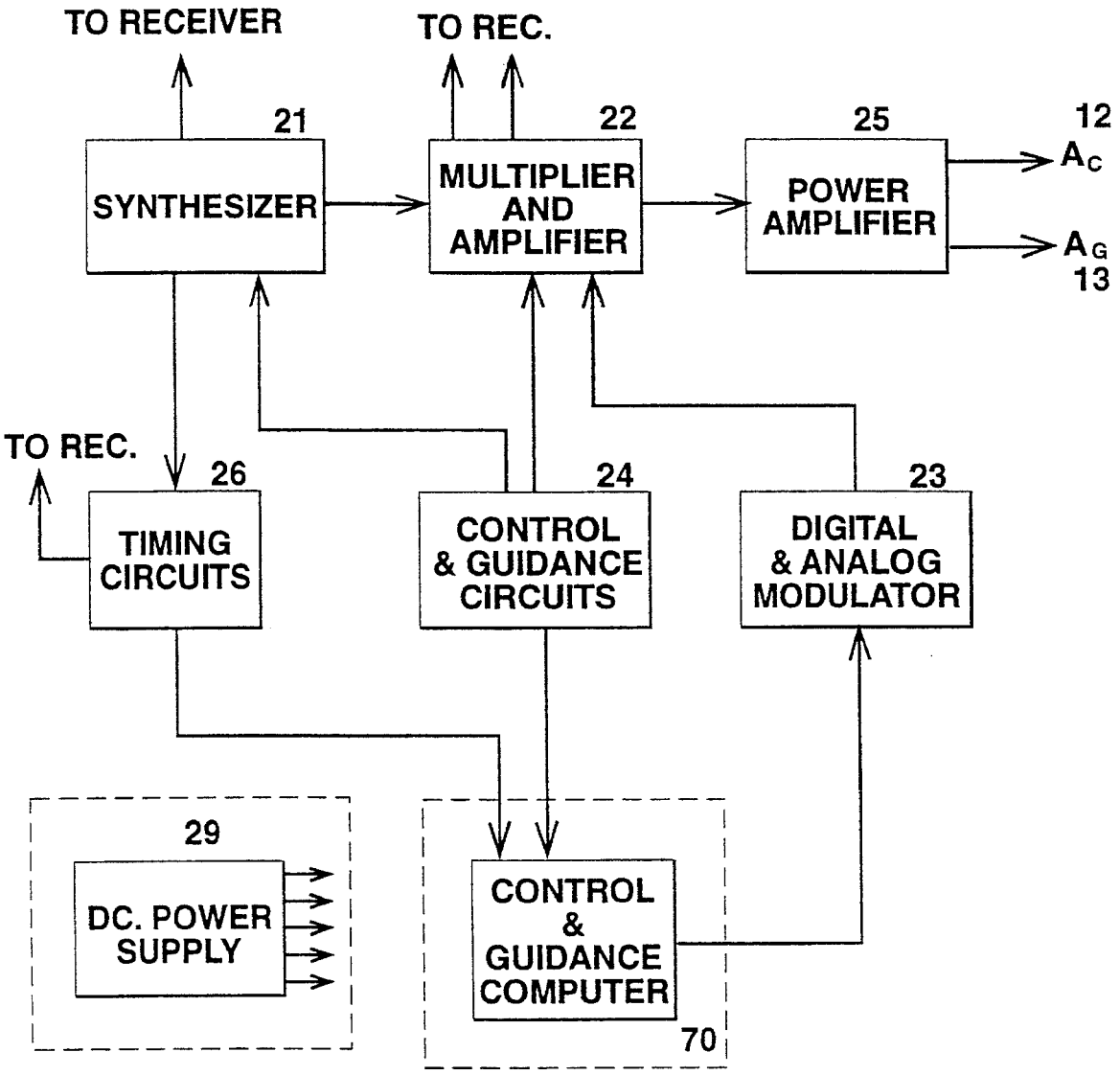
Figure 6:
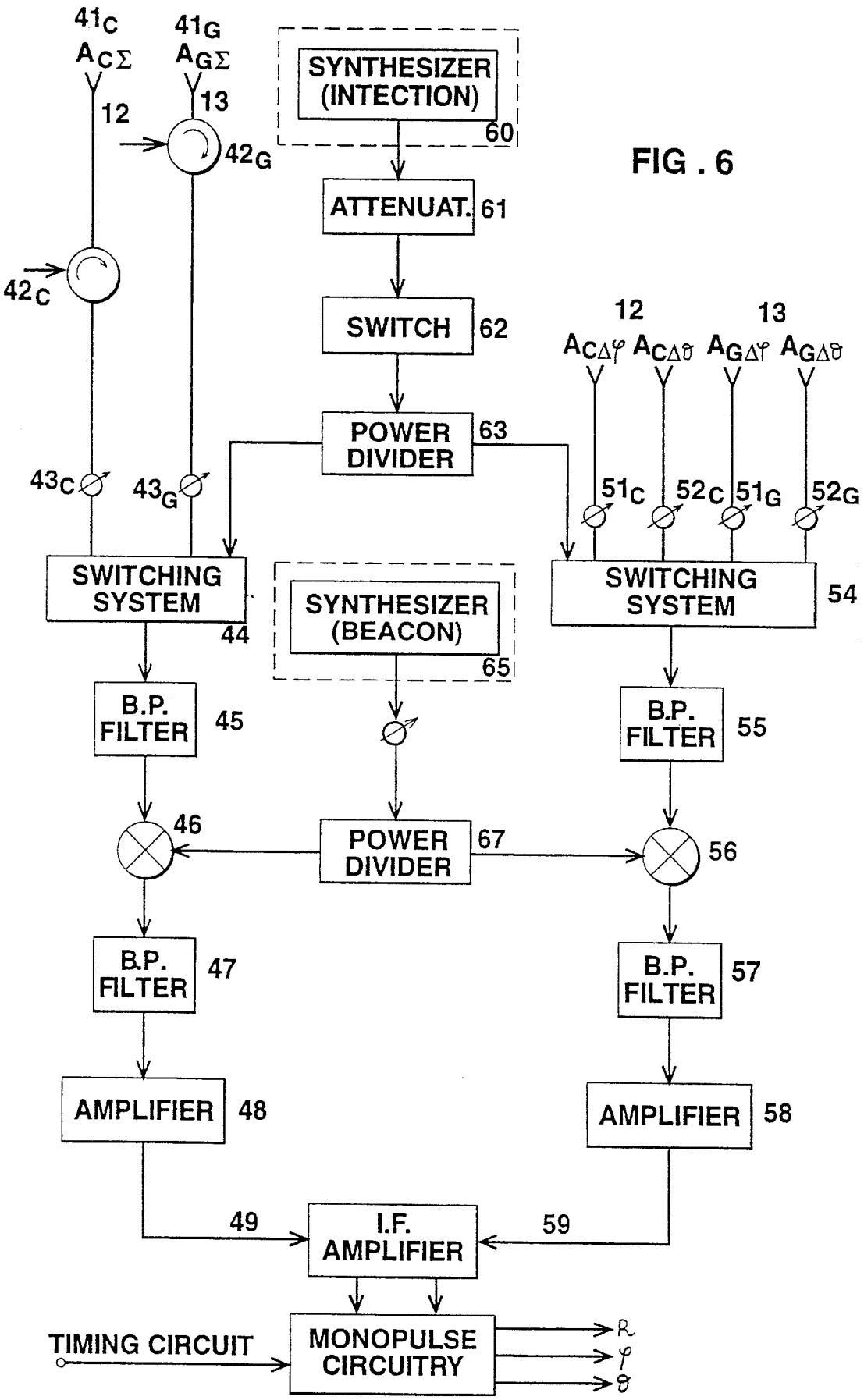

FIG. 4 pictorially illustrates the manner of operation of the fire control radar system when used for tracking and guiding missiles to the target;

FIG. 5 is a block diagram illustrating the command transmitter in the conversion kit of FIG. 3;

FIG. 6 is a block diagram illustrating the beacon receiver in the conversion kit of FIG. 3;

FIG. 7 is a flow chart illustrating the operation of the overall system when used for tracking and guiding missiles to the target;

FIG. 8 is a block diagram illustrating the synthetic target included in the conversion kit for calibrating the conversion kit;

FIG. 9 illustrates the self-calibration process using the synthetic target of FIG. 8;

and FIG. 10 illustrates the manner of measuring the physical distortion of the target radar antenna because of temperature variations to enable compensation to be effected for such variations.

Figure 1:
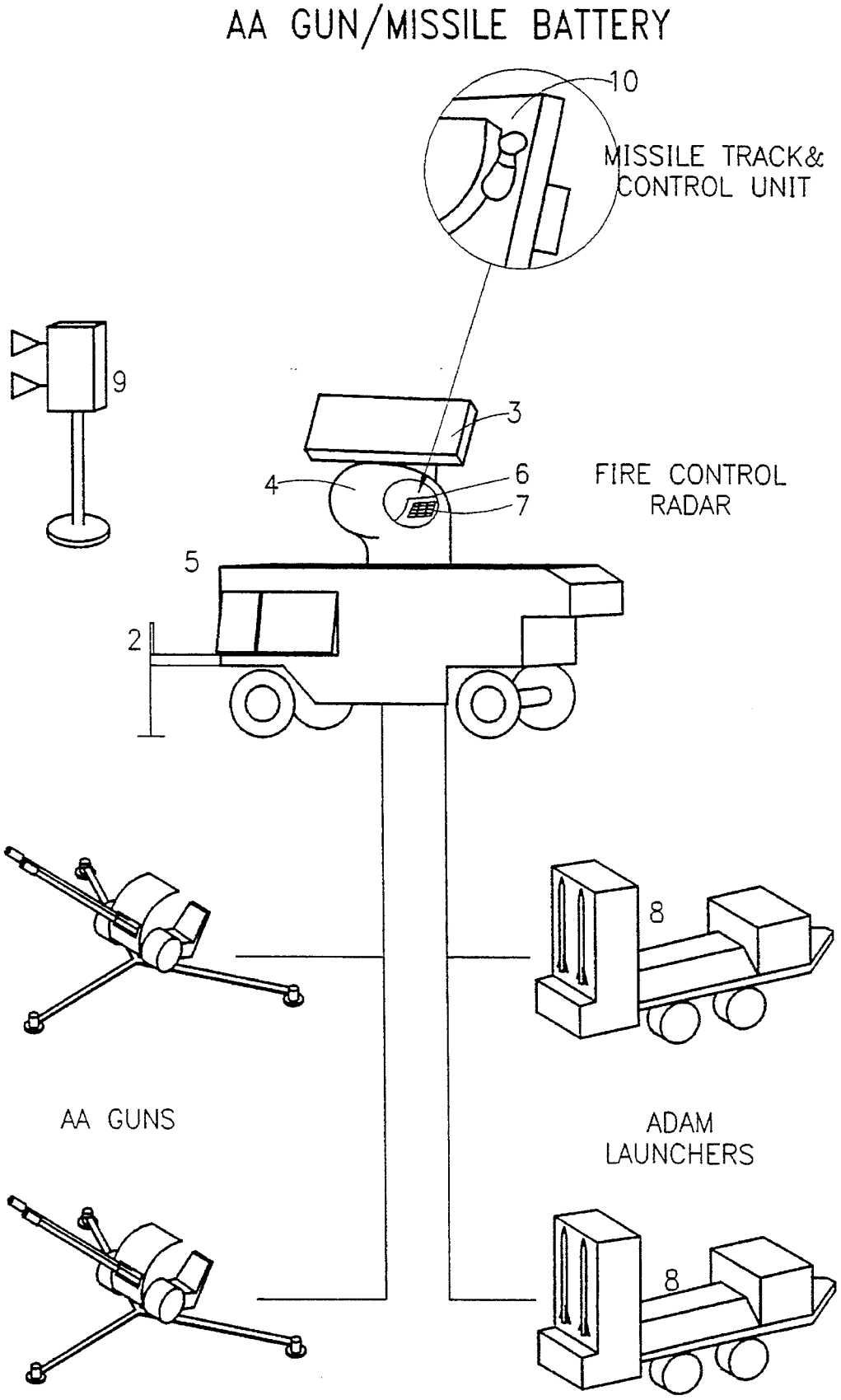
Figure 1A:
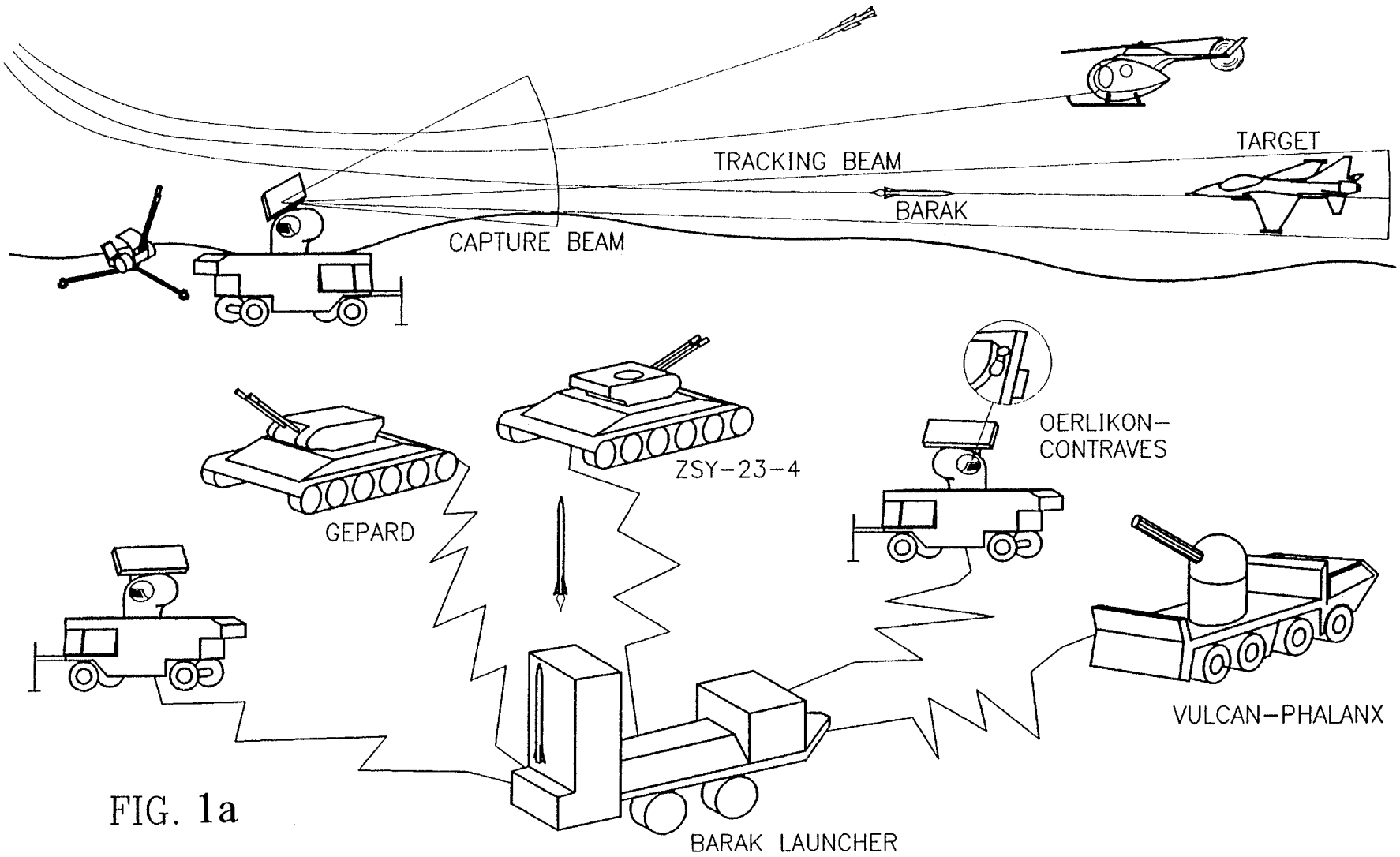

FIG. 1 illustrates an example of an existing fire control radar system, generally designated 2, used for controlling gun batteries. Such a system typically includes a search antenna 3, a target-tracking antenna 4, and a housing 5 containing the electronics and also the drives for the antennas 3 and 4. Since the fire control radar system itself is not part of the present invention, further details of the construction and operation of such a system are not set forth herein.

FIG. 1 also pictorially illustrates a missile launcher, generally designated 8, controlled by the radar system 2 when upgraded by the novel conversion kit to enable the system also to be used for tracking and guiding missiles to the target.

According to the present invention, there is provided a conversion kit for upgrading an existing fire control radar system such as shown at 2 in FIG. 1, for upgrading the system also for use in measuring, commanding and guiding missiles to a target. The main components of the conversion kit are a missile antenna assembly, generally designated 6, and more particularly illustrated in FIG. 2, attached to the target antenna 4 of the fire control radar system 2; an electronic system, generally designated 7, and more particularly illustrated in FIGS. 5 and 6; a synthetic target generating device, generally designated 9, and more particularly illustrated in FIGS. 8 and 9; and a system for measuring distortion of the target antenna 4, not shown in FIG. 1 but illustrated in FIG. 10, for compensating the distortion of the target antenna because of temperature variations.

Figure 2:
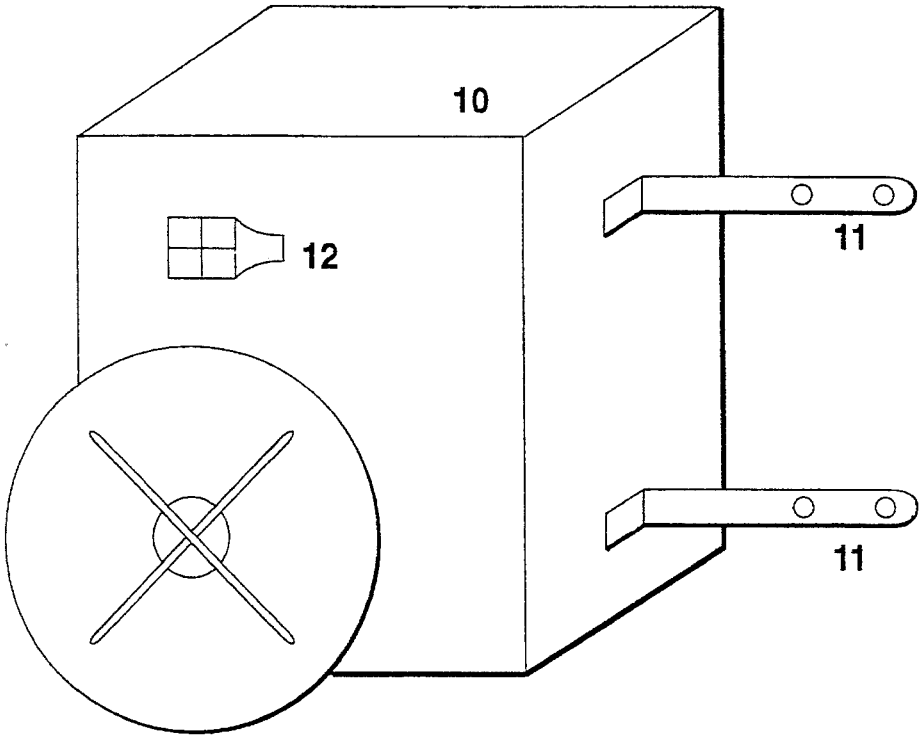
FIG. 2 illustrates the additional antenna assembly included in the conversion kit and mounted to the target antenna of the fire control radar system.

The missile antenna 6, as more particularly illustrated in FIG. 2, comprises a housing 10 attached to the target antenna 4 by a pair of brackets 11, so that the housing 10 moves with the target antenna. Housing 10 includes a capture antenna 12 in the form of four small horns for tracking the missile within a relatively wide capture beam, and a guidance antenna 13 in the form of a cassegraian antenna for measuring and commanding the missile within a relatively narrow guidance beam. Both types of monopulse antennas are well known, and therefore details of their constructions are not set forth herein. As one example, the capture antenna 12 may have a beam width of 10–18°, and the guidance antenna 13 may have a beam width of 1–2°.

FIG. 3 more particularly illustrates the electrical components of the conversion kit shown in housing 7 in FIG. 1, and how those components cooperate with the existing fire control radar system 2 for upgrading the system also to track and guide missiles launched by the missile launcher 8 to the target. The missile launcher 8, as well as its launch and control unit 8*a* schematically shown in FIG. 3, may also be an existing system, and therefore details of their construction and operation are not set forth herein.

As shown in FIG. 3, the conversion kit for upgrading the existing fire control radar system 2 includes, in addition to the capture antenna 12 and guidance antenna 13 to be attached to the radar system target antenna 4, together with the RF components of a transceiver, a command transmitter 20, a beacon receiver 30, and a guiding computer 40, all housed within housing 7 illustrated in FIG. 1. The command transmitter 20 transmits command signals to the missile via the missile antennas 12, 13. The beacon receiver 30 receives from the missile, also via the missile antennas 12, 13, response signals from the missile beacon transmitter in response to the reception by the missile of the command signals. The guidance computer 40 utilizes the command signals transmitted by the command transmitter 20, and the response signals received from the missile beacon transmitter, and also tracking signals received from the fire control radar system 2, for measuring and commanding the missile, thus guiding it to the target.

FIG. 4 pictorially illustrates the overall operation of the radar system when upgraded by means of the above-described conversion kit for measuring and guiding a missile M to a target T. Thus, as described with respect to FIG. 2, the missile capture antenna 12 and guidance antenna 13 are both fixed, by mounting brackets 11, to the target antenna 4 of the radar system 2, so that these missile antennas will move with the target antenna. The missile M is launched vertically, and is then steered by its own inertial guidance system towards the target T which is tracked by the target antenna 4 of the radar system 2. After a time $T_s$ (e.g., about 1–2 seconds) from the launch of the missile, the command transmitter sends, through the side lobes of the capture antenna, commands in order to drive the missile towards the capture beam of the capture antenna. After a time ($t_o=T_s+m\Delta t$) from the launch, the missile will enter the main capture beam generated by the capture antenna attached to the radar target antenna 4. Then the command transmitter 20 transmits command signals to the missile, and the beacon receiver 30 receives the response signals from the missile beacon transmitter, which signals are utilized for measuring the missile's trajectory and for guiding it towards the guidance antenna beam and therefore towards the target T. While the missile is within the capture beam 25A, the command signals are transmitted, and the response signals are received, via the capture antenna 12; but as soon as the missile enters the guidance beam 26A in FIG. 4, at time $t_1$ the command signals are transmitted and response signals are received via the guidance antenna 13. The guidance of the missile M is effected by the guidance computer 40 via the launch and control unit 8*a* (FIG. 3) of the missile launcher 8. The foregoing overall operation will be described more particularly with respect to the flow chart illustrated in FIG. 7.

FIG. 5 is a block diagram illustrating the construction of the command transmitter 20 which transmits the command signals to the missile. The command signals can be transmitted via different carrier frequencies in the K band to enable control of a plurality of missiles at the same location. Thus, each battery of missiles may be allocated a particular frequency for the transmission to it of a command signal from the command transmitter 20, and also for the corresponding transmission of its beacon signal in response to the reception of a command signal.

Thus, the command transmitter 20 illustrated in FIG. 5 includes a sythesizer 21 for synthesizing or generating any one of a plurality of different carrier frequencies. The carrier frequency is fed to a circuit 22 where it is modulated by the output of a digital modulator 23 and the output of a control and guidance circuit 24, both controlled by the control and guidance computer 40. The modulated carrier is then fed via power amplifier 25 to the capture antenna 12, or to the guidance antenna 13, for transmission to the missile M.

The control and guidance circuit 24 controls the switching times of the transmitter for synchronization purposes.

The carrier frequency generated by the synthesizer 21 is also applied to the beacon receiver 30, which circuit also receives the output of a timing circuit 26. This information enables the beacon receiver 30 to know when a command signal was transmitted to a particular missile, and therefore when a response signal from the beacon transmitter of that missile should be expected.

Circuit 22 also includes an output 27 and an output 28 serving as a reference signal to the beacon receiver 30 for calibration purposes. FIG. 5 also illustrates a DC power supply 29 for supplying power to the various components of the command and transmitter 20.

The beacon receiver 40 is more particularly illustrated in FIG. 6. This receiver receives, via the capture antenna 12 and the guidance antenna 13, information which enables the beacon receiver to determine the range of the missile transmitting the beacon signal, its azimuth and also its elevation. Both the capture antenna 12 and the guidance antenna 13 are quadrant-type antennas, such that the sum of the four quadrants is used to measure the range of the missile, the sum of the two right quadrants minus the sum of the two left quadrants is used to measure the azimuth of the missile, and the sum of the two upper quadrants minus the sum of the two lower quadrants is used to measure the elevation of the missile.

The range information is received via channel 41 of the beacon receiver 40. This channel 41 includes a sub-channel 41*c* for receiving the sum of the four quadrants from the capture antenna 12. Sub-channel 41*c* also includes a circulator 42*c* to send the transmitter output to the capture antenna, and a variable attenuator 43*c* for attenuating the circulator output before it is applied to switch 44. The guidance antenna sub-channel 41*g* includes a similar circulator 42*g* to send the transmitter output to the guidance antenna, and an attenuator 43*g* for the same attenuating purpose.

The variable attenuators 43*c*, 43*g* produce the proper level of the signal, and the switching circuit 44 is controlled to provide the appropriate transfer of the beacon signal from the capture antenna to the guidance antenna.

The output of the switching circuit 44 is fed via a filter 45 to remove noise, and then to a mixer 46. The mixer 46 receives a high frequency signal from a local oscillator to produce a beat frequency in the intermediate frequency range. The beat frequency is fed via a filter 47 and amplifier 48 to the output terminal 49, thereby providing an IF output that will be amplified and detected to provide the range of the respective missile.

The beacon receiver 40 further includes an azimuth channel 51 receiving the outputs from the two right quadrants, minus the outputs of the two left quadrants, of the capture antenna 12, to provide a measurement of the azimuth of the missile. Channel 51 therefore includes a sub-channel 51*c* for receiving outputs from the capture antenna 12, and a sub-channel 51g for receiving outputs from the guidance antenna 13. These outputs are fed via variable attentuators 52*c*, 52*g* to a switching system 54 control, for providing the appropriate consecutive measurements of azimuth and elevation for the respective missile whose beacon is being received and to transfer the signals from the capture antenna to the guidance antenna.

The elevation data is provided by channel 52 which receives the signals from the two upper quadrants, minus the signals from the two lower quadrants, to provide elevation data of the respective missile. This elevation channel 52 also includes sub-channel 52*c* for the capture antenna and 52*g* for the guidance antenna, both channels including attentuators 52*c*, 52*g*, before feeding their respective signal to the switching system 54.

The output of switching system 54 is fed via a filter 55 to remove noise, to a mixer 56 where its RF frequency is mixed with the RF frequency of the local oscillator to produce an IF output. The latter output is applied via filter 57 and amplifier 58, to produce an IF output representing the azimuth end elevation with respect to the target. The two signals are fed to the IF amplifier and to the monopulse circuitry for processing.

The signals controlling the switching systems 44 and 54 are supplied by the synthesizer 60 which belongs to the transmitter section of the kit.

The conversion of the RF signals received via channels 41, 51 and 52 to IF, via their respective mixers 46, 56, is generated by a synthesizer circuit 65 which is fed via an attenuator 66 and power divider 67 to the two mixers 46, 56.

It will thus be seen that the output appearing on terminal 49 of the beacon receiver 40 relates to the range of the missile; whereas the output appearing at terminal 59 relates to the error in the azimuth and elevation of the missile with respect to the target. This information is fed by the beacon receiver 30 to the guidance computer 40 (FIG. 3), and is used to guide the missile to the target by reducing the output signal appearing on terminal 59 towards zero.

FIG. 7 is a flow chart illustrating the overall operation of the system, particularly the guidance computer 40.

Thus, after the missile has been launched, the system waits for time $T_O$. Then, the command transmitter 20 transmits a command signal via the capture antenna 12 (block 72), and the system then waits for the reception of a valid beacon signal from the missile (block 73). If a valid beacon signal is not received within a predetermined time interval (block 74), another command signal is transmitted (block 75), assuming that the total time interval has not exceeded time $T_D$ (self-destruct time). If time $T_D$ has been exceeded, the system informs the missile launching control unit (8*a*, FIG. 3), (block 77), whereupon that unit will self-destroy the missile.

If, however, a valid beacon was received from the missile, within a predetermined time interval after the transmission of the command signal, the system measures the azimuth ($\phi_m$), elevation ($\theta_m$), and range ($R_m$) of the missile (block 74A). This measurement is compared with the azimuth ($\phi_t$), elevation ($O_t$) and range ($R_t$) of the target, as measured by the fire control radar system 2, which information is received by the guidance computer 40 (block 75A).

The guidance computer 40 then computes a new trajectory for convergence of the missile on the target, and the proper commands regarding this new trajectory are transmitted (block 77A).

During these operations, the guidance computer checks to determine whether a valid beacon is received (block 78), and if not, it returns to measure the azimuth, elevation and range of the missile (block 74A). Assuming a valid beacon signal is still received, the guidance computer checks to determine whether the guidance criteria have been met (block 79), and if not, it returns the system to the same point (block 74A) for measuring the azimuth, elevation and range of the missile.

When the foregoing criteria have been met with respect to the signals received by the capture antenna, this means that the missile has entered the guidance beam 26 (FIG. 4), and the signals received by the guidance antenna 13 are now effective to track the missile and to guide it towards the target T. Thus, the signals received by the guidance antenna 13 are used for measuring the azimuth, elevation and range of the missile (block 80), are compared with the azimuth, elevation and range of the target (block 81), and are used for computing a new trajectory (block 82), which is transmitted to the missile (block 83), as described above with respect to the signals received by the capture antenna 12.

The system continuously checks to see whether a beacon is still being received (block 84), and so long as a beacon is being received, the system is returned to the beginning of block 79 in order to reduce towards zero the error with respect to the azimuth, elevation and range of the missile with respect to the target. This loop is repeated until no beacon signal is received, that is until the missile stops transmitting its beacon signal, presumably because of detonation of the missile.

As indicated earlier, the conversion kit includes a synthetic target, shown at 9 in FIG. 1, to enable the system to be calibrated after being attached to the target antenna 4 of the fire control radar system 2. FIG. 8 illustrates the main elements included in the synthetic target 9. Thus, as shown in FIG. 8, the synthetic target 9 includes a repeater 91 adapted to be located at a predetermined know location with respect to the target antenna 4 of the radar system 2. Repeater 91 is adapted to transmit a signal corresponding to the echo received by the fire control radar system when tracking a target.

The synthetic target 9 further includes a beacon transmitter 92 at the same known predetermined location as the repeater 91, for transmitting a beacon signal corresponding to that transmitted by the missile to be tracked. The synthetic target 9 further includes a synthetic target antenna assembly 93 at the same location, and including a missile antenna 93M, and a target antenna 93*t*, both having an accurate known electromagnetic center T.

The synthetic target 9 further includes a controller 94 having means for operating the repeater 91 and the beacon transmitter 92. The mutual mapping of the beams of the Fire Control Radar (FCR), of the capture antenna and of the guidance antenna can now be performed for every frequency of the FCR tracking antenna 4 with respect to every frequency of the kit antennas 12, 13 over the entire working frequency band.

The manner of using this information from the synthetic target antenna 9 is schematically illustrated in FIG. 9.

Thus, the target antenna 4 on the radar system 2 transmits a pulse to the synthetic target 9, at a predetermined range and orientation with respect to the target antenna 4, and therefore with respect to the missile antenna assembly 10 (i.e., that is its capture antenna 12 and guidance antenna 13). The radar repeater 91 of the synthetic target 9 transmits a signal corresponding to the echo received by the fire control radar when tracking in a target, which echo signal is received by the radar receiver, as schematically indicated by block 96, and used for locking the target antenna on to the synthetic target, therefore determining the azimuth and elevation of the synthetic target. This information is fed to a self-calibration table 98.

At the same time, the commander transmitter transmits a command signal to the synthetic target, which triggers to transmit its beacon signal, the latter signal being received by the receiver of the guidance antenna, as schematically indicated by block 97, which computes the azimuth and elevation of the synthetic target. The difference between the computations of blocks 96 and 97 represent the error for the respective azimuth and elevation, and these errors are introduced into the self-calibration table 98 to be used for correcting the actual computations made during the normal operation of the system. Thus, for every couple of frequencies $F_t$, of the FCR and $F_m$ of the kit, we can measure the errors $\Delta\phi_m$ and $\Delta\theta_m$. This calibration allows us to correct for the misalignment of the boresight of the three antennas due to manufacturing, mounting and also working at different frequencies. The calibration will be performed over the beam width of the guidance antenna.

Because wide variations in temperature can produce distortions in the antennas, which can significantly affect the operation of the system, the conversion kit further includes means for measuring the distortion of the antennas during wide temperature variations. Since the target antenna 4 provided on the radar system 2 is much larger than the missile antennas 12 and 13 included in the conversion kit, the measurement of antenna distortion is made with respect to the target antenna.

Thus, as shown in FIG. 10, the system for measuring the physical distortion of the target antenna 4 because of temperature variations includes a point-source light emitter 100 adapted to be located at a predetermined known location with respect to the antenna 4; a light detector 101 also adapted to be located at a predetermined location with respect to target antenna 4; a first mirror 102 located on the target antenna for receiving light from the point-source light emitter 100; and a second mirror 103 located on the target antenna at a known predetermined location with respect to mirror 102 and oriented to receive the light reflected from mirror 102 and to reflect the light towards the light detector 101. The measuring system further includes a gauge 104 for computing the physical distortion of the antenna, represented by the differences in the actual point of impingement of the light on the light detector as compared to the theoretical point of impingement thereon in the absence of any physical distortion of the antenna. Once the physical distortion has been determined with respect to the points of location of the two mirrors 102, 103, the physical distortion of the other points on the surface of the target antenna can be computed since the geometry of the target antenna is known. Similarly, the distortion of the missile antennas 12 and 13 can also be computed since the geometries of these antennas are known. The bore sights of these antennas may therefore be compensated for the distortions caused by these temperature deviations.

Preferably, the point-source light emitter 100 is a laser.

While the invention has been described with respect to one preferred embodiment, it will be appreciated that this is set forth merely for purposes of example, and that many other variations, modifications and applications of the invention may be made.

What is claimed is:

1. A conversion kit for upgrading an existing fire control radar system having a target radar antenna for tracking a target to enable the system also to track, with respect to the target, a missile having a beacon transmitter, said conversion kit comprising:

missile antenna means for measuring and commanding the missile;

means for attaching the missile antenna means to the target radar antenna of the fire control radar system;

a command transmitter for transmitting command signals via said missile antenna means to a missile;

a beacon receiver for receiving from the missile, via said missile antenna means, response signals from the missile beacon transmitter in response to the reception by the missile of said command signals;

and a guidance computer for utilizing said command signals transmitted by said command transmitter, and said response signals received from the missile beacon transmitter, and target tracking signals received from the fire control radar system, for tracking the missile and for guiding the missile to the target.

2. The conversion kit according to claim 1, wherein said kit further includes means for generating a synthetic target at a predetermined known location with respect to said missile antenna, and means to enable self-calibration of the conversion kit with respect to the target radar antenna for different frequencies of the target antennas and of the kit antennas.

3. The conversion kit according to claim 2, wherein said means for generating a synthetic target comprises:

a repeater at said predetermined known location for transmitting a signal corresponding to an echo received by the fire control radar when tracking a target;

a beacon transmitter at said known predetermined location for transmitting a beacon signal corresponding to the signal transmitted by the missile to be tracked;

synthetic target antenna means at said predetermined known location, including a missile antenna and a target antenna having an accurately known electromagnetic center;

and a controller including means for operating said repeater and said beacon transmitter;

said guidance computer further including means for computing and recording from the signals received by said target radar antenna of the radar system, and said missile antenna means of the conversion kit, the errors in azimuth and elevation when said repeater and beacon transmitter are triggered at said different frequencies over their respective frequency band and over the bandwidth of the guidance antenna.

4. The conversion kit according to claim 1, wherein said missile antenna means comprises a monopulse capture antenna for measuring and commanding the missile within a relatively wide capture beam; and a monopulse guidance antenna for measuring and commanding the missile within a relatively narrow guidance beam.

5. The conversion kit according to claim 4, wherein the beam width of said monopulse capture antenna is 10–18°.

6. The conversion kit according to claim 4, wherein the beam width of said monopulse guidance antenna is 1–2°.

7. The conversion kit according to claim 1, further including means for measuring the physical distortion of the target radar antenna because of variations in temperature, said guidance computer including means for correcting the measurements of the missile and the guidance thereof to the target to compensate for said physical distortion.

8. The conversion kit according to claim 7, wherein said means for measuring the physical distortion of the target radar antenna comprises:

a point-source light emitter adapted to be located at a predetermined known location with respect to said target radar antenna;

a light detector adapted to be located at a predetermined known location with respect to said target radar antenna;

a first mirror located on said target radar antenna for receiving light from said point-source light emitter;

a second mirror located on said target radar antenna at a known predetermined location with respect to said first mirror and oriented to receive the light reflected from said first mirror, and to reflect said light to said light detector;

and means for measuring the physical distortion of said target radar antenna for the differences in the actual point of impingement of the light on said light detector as compared to the theoretical point of impingement thereon in the absence of any physical distortion of the antenna.

* * * * *